US010423100B2

(12) United States Patent
Minamino

(10) Patent No.: US 10,423,100 B2
(45) Date of Patent: Sep. 24, 2019

(54) IMAGE FORMING APPARATUS

(71) Applicant: KYOCERA Document Solutions Inc., Osaka (JP)

(72) Inventor: Koji Minamino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/232,173

(22) Filed: Dec. 26, 2018

(65) Prior Publication Data

US 2019/0196370 A1 Jun. 27, 2019

(30) Foreign Application Priority Data

Dec. 27, 2017 (JP) ..... 2017-251471

(51) Int. Cl.
*G03G 15/00* (2006.01)
*G03G 15/20* (2006.01)

(52) U.S. Cl.
CPC ..... *G03G 15/2028* (2013.01); *G03G 15/5062* (2013.01)

(58) Field of Classification Search
CPC ..... G03G 15/2028; G03G 15/2039; G03G 15/50; G03G 15/5062; G03G 15/5095; G03G 2215/2083
See application file for complete search history.

(56) References Cited

U.S. PATENT DOCUMENTS

2008/0019727 A1* 1/2008 Honma ..... B41J 3/60 399/82
2010/0225932 A1* 9/2010 Kurose ..... G03G 15/5062 358/1.1
2015/0070732 A1* 3/2015 Kishi ..... G03G 15/5062 358/3.27
2015/0277307 A1* 10/2015 Goto ..... G03G 15/5062 399/49

FOREIGN PATENT DOCUMENTS

JP 2013-222015 A 10/2013

* cited by examiner

*Primary Examiner* — Sophia S Chen
(74) *Attorney, Agent, or Firm* — Studebaker & Brackett PC

(57) ABSTRACT

An image forming apparatus includes an image forming section, a fixing section, a detector, and a controller. A recording medium has a first surface and a second surface. A pair of marks is formed on the second surface with ink that becomes transparent at a specific temperature or higher. The controller calculates a distance between the marks based on a detection result of the detector after the fixing section has fixed toner to the first surface. The controller calculates a shrinkage of the recording medium based on the calculated distance. The image forming section forms an image on the second surface according to the shrinkage. The fixing section fixes the toner to the first surface at a first fixing temperature which is lower than the specific temperature. The fixing section fixes the toner to the second surface at a second fixing temperature which is higher than the specific temperature.

7 Claims, 6 Drawing Sheets

IMAGE FORMING APPARATUS

INCORPORATION BY REFERENCE

The present application claims priority under 35 U.S.C. § 119 to Japanese Patent Application No. 2017-251471, filed on Dec. 27, 2017. The contents of this application are incorporated herein by reference in their entirety.

BACKGROUND

The present disclosure relates to an image forming apparatus.

A known image forming apparatus performs printing on paper having a width larger than a maximum printable width of the image forming apparatus. In detail, the image forming apparatus forms an image on the paper having the width larger than the maximum width by printing on obverse and reverse surfaces of the paper that has been folded.

SUMMARY

An image forming apparatus according to an aspect of the present disclosure includes an image forming section, a fixing section, a detector, and a controller. The image forming section forms an image on a recording medium. The recording medium has a first surface and a second surface. The fixing section fixes toner to the recording medium. The detector detects a pair of marks formed on the second surface. The controller controls the image forming section, the fixing section, and the detector. The pair of marks is formed with ink that becomes transparent at a specific temperature or higher. The controller calculates a calculated distance indicating a distance between the pair of marks based on a detection result of the detector after the fixing section has fixed the toner to the first surface. The controller calculates a shrinkage of the recording medium based on the calculated distance. The controller directs the image forming section to form an image on the second surface according to the shrinkage. The fixing section fixes the toner to the first surface at a first fixing temperature which is lower than the specific temperature. The fixing section fixes the toner to the second surface at a second fixing temperature which is higher than the specific temperature.

DETAILED DESCRIPTION

Figure 1:
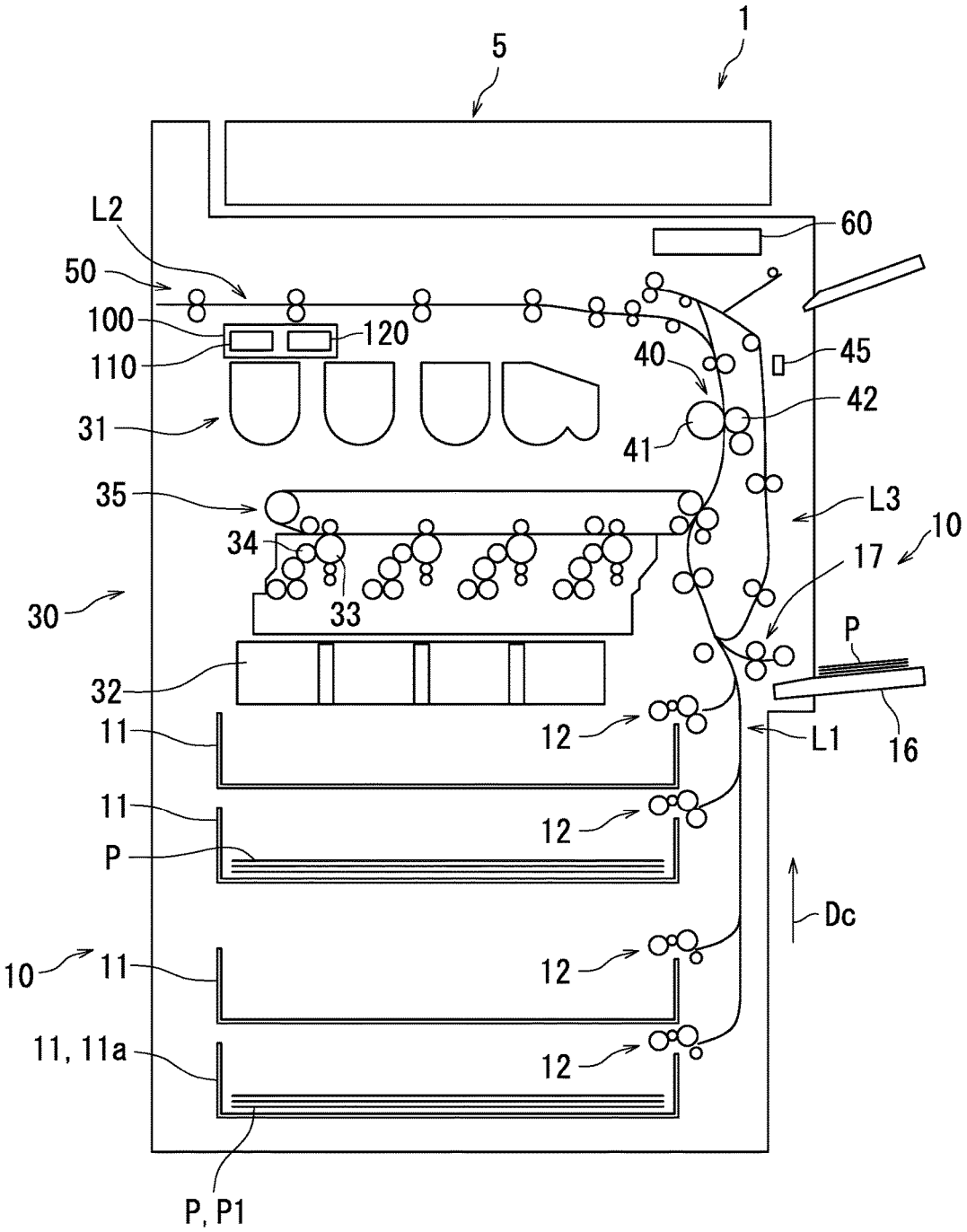
FIG. 1 is a schematic illustration of an image forming apparatus according to an embodiment of the present disclosure.

The following describes an embodiment of the present disclosure with reference to the accompanying drawings. Note that elements that are the same or equivalent are labelled with the same reference signs in the drawings and description thereof is not repeated.

Figure 2A:
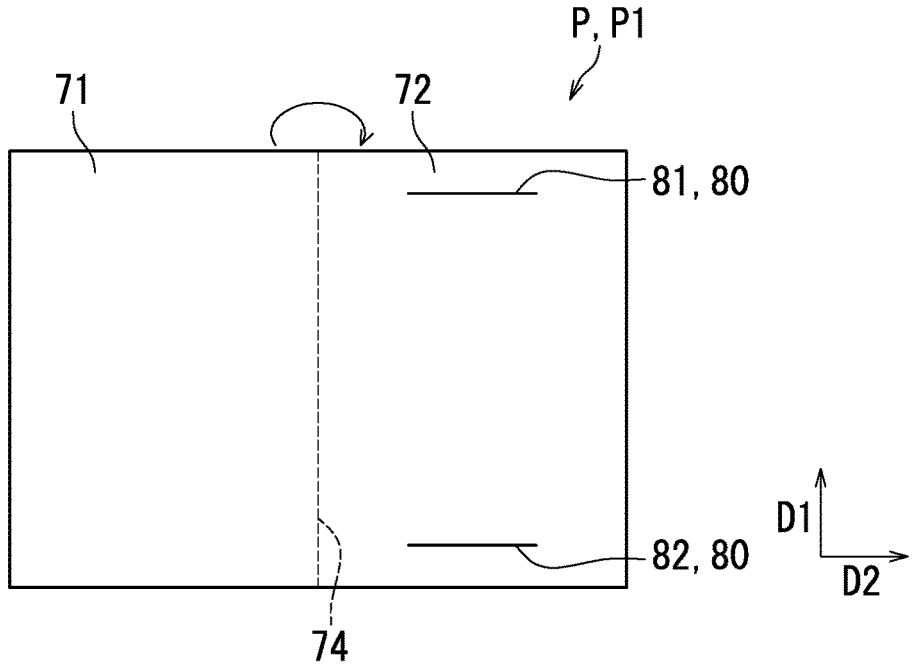
FIGS. 2A and 2B are schematic illustrations of paper before printing.
Figure 2B:
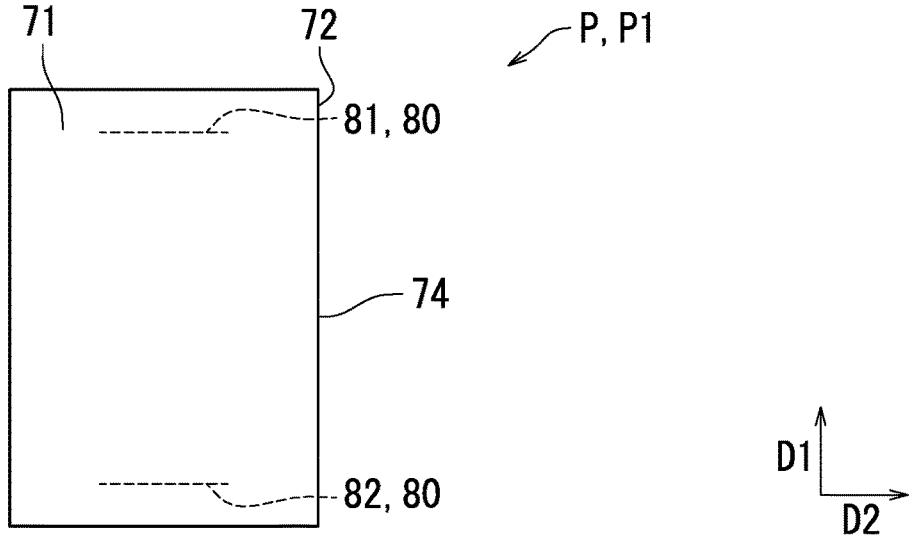

An image forming apparatus 1 according to the embodiment of the present disclosure is described with reference to FIGS. 1 to 4B. FIG. 1 is a schematic illustration of the image forming apparatus 1 according to the embodiment of the present disclosure. FIGS. 2A and 2B are schematic illustrations of paper P before printing.

The image forming apparatus 1 is a color multifunction peripheral according to the present embodiment. The image forming apparatus 1 has a simplex printing mode, a duplex printing mode, and a large-size printing mode. The simplex printing mode is an operation mode in which an image is formed on only one of two surfaces of the paper P. The paper P is an example of a recording medium. The duplex printing mode is an operation mode in which an image is formed on both of the two surfaces of the paper P. The large-size printing mode is an operation mode in which an image is formed on paper P that is larger than a size that can be loaded into a later-described paper feed cassette 11. According to the present embodiment, the large-size printing mode allows printing on A3-sized paper P.

As illustrated in FIG. 1, the image forming apparatus 1 includes a document reading section 5, a paper feed section 10, an image forming section 30, a fixing section 40, a detector 45, an ejection section 50, an input section 60, and a control board 100. The image forming apparatus 1 also includes a first conveyance section L1, a second conveyance section L2, and a third conveyance section L3.

The document reading section 5 scans an original document to obtain input image data.

The paper feed section 10 includes a plurality of paper feed cassettes 11 and a plurality of first paper feed roller groups 12. Each of the paper feed cassettes 11 can house multiple sheets of paper P. Each of the paper feed cassettes 11 can house A4-sized paper. Each of the first paper feed roller groups 12 feeds the paper P housed in a corresponding paper feed cassette 11 to the first conveyance section L1 a sheet at a time. The paper feed cassettes 11 include a dedicated paper feed cassette 11*a* which houses paper P to be used in the large-size printing mode.

The paper feed section 10 further includes a manual feed tray 16 and a second paper feed roller group 17. The manual feed tray 16 can hold multiple sheets of paper P. The second paper feed roller group 17 feeds the paper P loaded on the manual feed tray 16 to the first conveyance section L1 a sheet at a time.

The first conveyance section L1 conveys the paper P in a conveyance direction Dc. In detail, the first conveyance section L1 conveys the paper P fed by the paper feed section 10 to the fixing section 40 by way of a transfer device 35 included in the image forming section 30.

The following describes the paper P housed in the dedicated paper feed cassette 11*a* with reference to FIGS. 2A and 2B. Folded paper P is housed in the dedicated paper feed cassette 11*a*. In the following, the folded paper P among the paper P is also referred to as folded paper P1. FIG. 2A is a schematic illustration of the folded paper P1 in an unfolded state. FIG. 2B is a schematic illustration of the folded paper P1 in a folded state. In FIGS. 2A and 2B, a first direction D1 is parallel to the conveyance direction Dc (refer to FIG. 1) of the paper P A second direction D2 is orthogonal to the first direction D1.

As illustrated in FIG. 2A, the folded paper P1 has a first surface 71, a second surface 72, and a fold line 74. The first surface 71 is left of the fold line 74. The second surface 72 is right of the fold line 74. The first surface 71 and the second surface 72 are substantially equal in size. In the unfolded state, the folded paper P1 is A3-sized. The folded paper P1 is folded along the fold line 74. In the folded state illustrated in FIG. 2B, the folded paper P1 is A4-sized. Accordingly, the folded paper P1 can be housed in the dedicated paper feed cassette 11*a* which can house A4-sized paper.

A pair of marks 80 is formed on the second surface 72. The marks 80 include a first mark 81 and a second mark 82. The first mark 81 and the second mark 82 are formed with ink that becomes transparent at a specific temperature or higher. In the following, the specific temperature at which the ink becomes transparent is also referred to as an ink transparency temperature. The first mark 81 and the second mark 82 are lines. The first mark 81 and the second mark 82 are parallel to each other. The first mark 81 and the second mark 82 extend in the second direction D2.

The following refers to FIG. 1 once more. The image forming section 30 forms an image on the paper P conveyed to the transfer device 35 by the first conveyance section L1. In addition to the transfer device 35, the image forming section 30 includes a toner replenishment device 31, an exposure device 32, a photosensitive drum 33, and a development roller 34.

The toner replenishment device 31 replenishes the development roller 34 with toner.

According to image data, the exposure device 32 irradiates the photosensitive drum 33 with laser light, thus forming an electrostatic latent image thereon. The development roller 34 supplies the toner to the corresponding photosensitive drum 33 to develop a toner image. Therefore, a toner image is formed on the photosensitive drum 33.

The transfer device 35 transfers the toner image formed on the photosensitive drum 33 to the paper P. The paper P with the toner image transferred thereto is conveyed to the fixing section 40. In a situation in which an image is formed using toners of different colors, the transfer device 35 transfers toner images formed on photosensitive drums 33 corresponding to the respective colors to the paper P in such a manner that the toner images are superimposed on one another.

The fixing section 40 includes a heating member 41 and a pressure member 42. The fixing section 40 applies heat and pressure from the heating member 41 and the pressure member 42 to the paper P, thus fixing the unfixed toner image to the paper P.

The second conveyance section L2 conveys the paper P conveyed from the fixing section 40 toward the third conveyance section L3 or the ejection section 50.

The ejection section 50 ejects the paper P out of the main body of the image forming apparatus 1.

The third conveyance section L3 is used in the duplex printing mode and the large-size printing mode. The third conveyance section L3 inverts the paper P conveyed from the second conveyance section L2 and conveys the paper P to the first conveyance section L1. In detail, the third conveyance section L3 conveys the paper P to a position downstream of the paper feed section 10 and upstream of the transfer device 35 in the first conveyance section L1. As a result, the paper P is reconveyed in an inverted posture by the first conveyance section L1. Therefore, an image based on the input image data can be formed on both sides of the paper P in the duplex printing mode. Additionally, an image based on the input image data can be formed on the first surface 71 and the second surface 72 in the large-size printing mode.

The detector 45 is provided in the third conveyance section L3. The detector 45 is an image sensor, for example. The detector 45 detects the pair of marks 80 formed on the second surface 72 of the paper P.

The input section 60 is located in an upper portion of the main body. The input section 60 displays an input screen. The input section 60 receives input operation from a user and generates input data according to the input operation. Furthermore, the input section 60 outputs a result of processing by a controller 120. The input section 60 is a touch panel or an operation panel with operation buttons and a touch panel, for example.

Storage 110 and the controller 120 are mounted on the control board 100. The storage 110 stores programs and settings information therein, for example. The storage 110 includes a hard disk drive (HDD), random-access memory (RAM), and read-only memory (ROM). The controller 120 controls operation of each section of the image forming apparatus 1 by executing a control program prestored in the storage 110.

Figure 3:
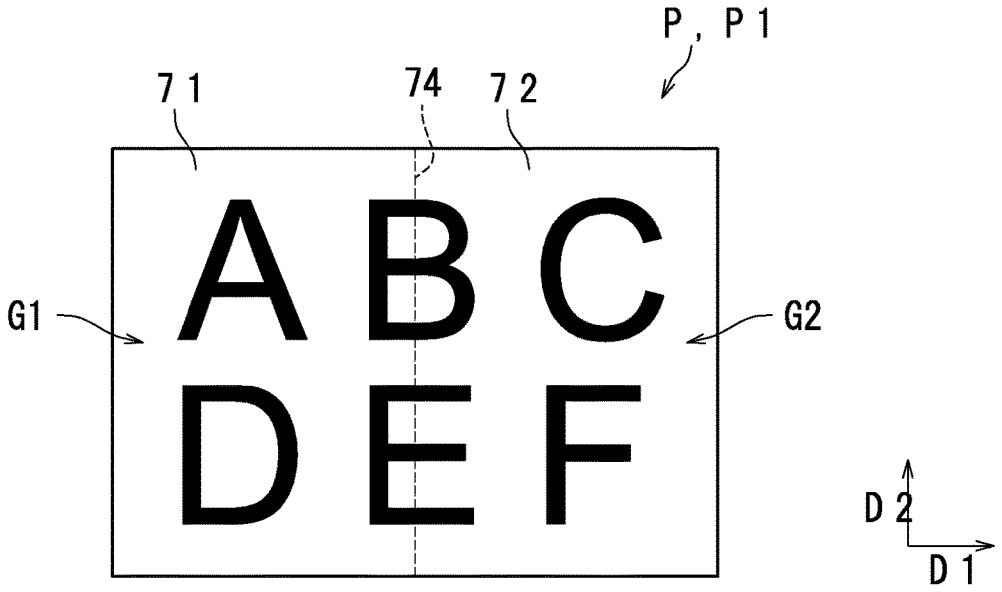
FIG. 3 is a schematic illustration of the paper after printing.

FIG. 3 is a schematic illustration of the paper P after printing. An image exhibiting characters "ABCDEF" is formed on the paper P illustrated in FIG. 3. As illustrated in FIG. 3, the controller 120 directs the image forming section 30 to form an image based on the input image data on the first surface 71 and the second surface 72 of the folded paper P1 in the large-size printing mode. In detail, the controller 120 divides the image based on the input image data into two equally sized images. The controller 120 then directs the image forming section 30 to form an image G1 on the first surface 71. The image G1 is left among the two images. The controller 120 also directs the image forming section 30 to form an image G2 on the second surface 72. The image G2 is right among the two images. Accordingly, as illustrated in FIG. 3, the image based on the input image data can be formed across the first surface 71 and the second surface 72. Thus, the image can be formed on the A3-sized paper P.

Figure 4A:
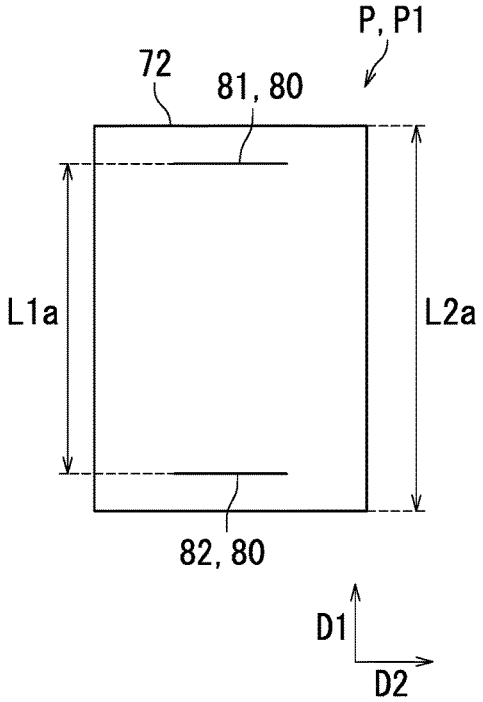
FIGS. 4A and 4B are schematic illustrations of a second surface of folded paper.
Figure 4B:
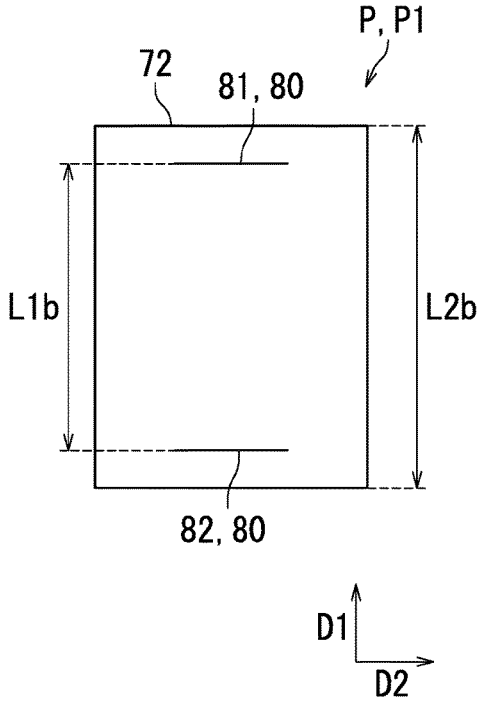

The following describes shrinking of the paper P due to printing on the first surface 71 with reference to FIGS. 4A and 4B. FIGS. 4A and 4B are schematic illustrations of the second surface 72 of the folded paper P1. FIG. 4A illustrates the second surface 72 of the paper P before printing. FIG. 4B illustrates the second surface 72 of the paper P after toner has been fixed to the first surface 71. In FIG. 4A, a distance L1*a* indicates a distance between the first mark 81 and the second mark 82. A length L2*a* indicates a length of a long side of the paper P. For example, the distance L1*a* is 200 mm and the length L2*a* is 297 mm. In FIG. 4B, a calculated distance L1*b* indicates a distance between the first mark 81 and the second mark 82. A length L2*b* indicates a length of the long side of the paper P. For example, the calculated distance L1*b* is 198 mm and the length L2*b* is 294.03 mm.

Upon heat being applied to the paper P, the paper P shrinks due to moisture included in the paper P decreasing. Accordingly, the paper P shrinks due to the heat of the fixing section 40 after toner has been fixed to the first surface 71 by the fixing section 40. That is, the length L2*b* is shorter than the length L2*a*. The calculated distance L1*b* is also shorter than the distance L1*a*.

The controller 120 calculates a shrinkage R based on the distance L1*a* and the calculated distance L1*b*. The shrinkage R indicates shrinkage of the paper P when an image is formed on the first surface 71. For example, the controller 120 calculates the shrinkage R using the formula L1*b*/L1*a*. In the present embodiment, the controller 120 calculates the shrinkage R with the following formula: 198 mm/200 mm=0.99.

In the image forming apparatus 1, the controller 120 directs the image forming section 30 to form an image on the second surface 72 according to the shrinkage R. In detail, the controller 120 scales down the image to be formed on the second surface 72 according to the shrinkage R. The controller 120 then directs the image forming section 30 to form the scaled down image on the second surface 72. Accordingly, printing can be performed on the second surface 72 according to the shrinkage R of the paper P. As a result, misalignment between printing positions of the first surface 71 and the second surface 72 can be prevented.

Figure 5:
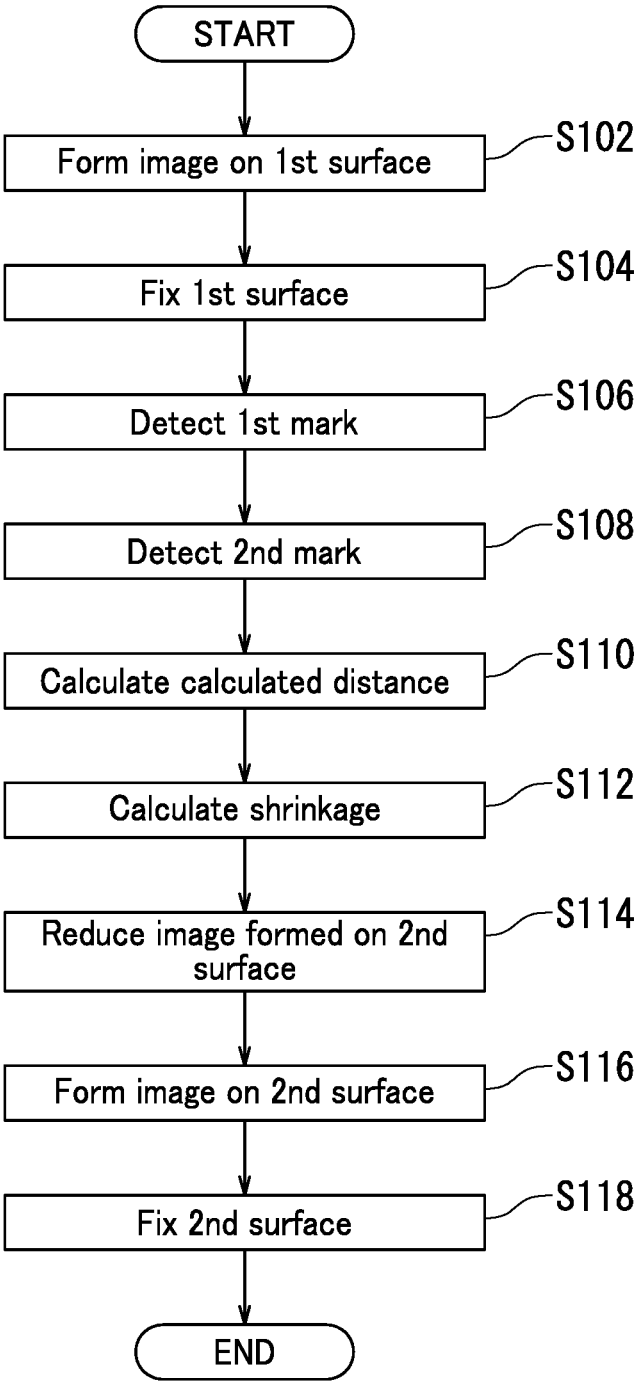
FIG. 5 is a flowchart illustrating operation of the image forming apparatus.

The following describes an image formation method in the large-size printing mode with reference to FIGS. 1, 4, and 5. FIG. 5 is a flowchart illustrating operation of the image forming apparatus 1. An image is formed on A3-sized paper P through the process performed from Step S102 to Step S118 illustrated in FIG. 5.

Step S102: The controller 120 directs the image forming section 30 to form an image on the first surface 71. The process then advances to Step S104.

Step S104: The controller 120 directs the fixing section 40 to fix toner to the first surface 71 at a first fixing temperature. The first fixing temperature is lower than the ink transparency temperature. Accordingly, the marks 80 formed on the second surface 72 do not become transparent when the fixing section 40 fixes the toner to the first surface 71. The process then advances to Step S106.

Step S106: The detector 45 detects the first mark 81 after the fixing section 40 has fixed the toner to the first surface 71. The controller 120 stores a time t1 at which the detector 45 detects the first mark 81 in the storage 110. The process then advances to Step S108.

Step S108: The detector 45 detects the second mark 82. The controller 120 stores a time t2 at which the detector 45 detects the second mark 82 in the storage 110. The process then advances to Step S110.

Step S110: The controller 120 calculates the calculated distance L1*b* (refer to FIG. 4B) based on the detection result of the detector 45. The controller 120 calculates the calculated distance L b using the following Formula 1, for example. The process then advances to Step S112.

$$L1b=(t2-t1)\times V \quad \text{(Formula 1)}$$

L1*b* is the calculated distance. t1 is the time at which the detector 45 detects the first mark 81 in Step S106. t2 is the time at which the detector 45 detects the second mark 82 in Step S108. V is a conveyance speed of the paper P.

Step S112: The controller 120 calculates the shrinkage R of the paper P based on the calculated distance L1*b*. In detail, the controller 120 calculates the shrinkage R of the paper P with respect to the first direction D1. The controller 120 calculates the shrinkage R using the following Formula 2, for example. The process then advances to Step S114.

$$R=L1b/L1a \quad \text{(Formula 2)}$$

R is the shrinkage R of the paper P. The distance L1*a* indicates an initial value of the distance between the first mark 81 and the second mark 82. The calculated distance L1*b* is the distance calculated by the controller 120 in Step S108. In the following, the initial value of the distance between the first mark 81 and the second mark 82 is also referred to as an initial distance. The initial distance L1*a* is preset by the user inputting through the input section 60, for example.

For example, the shrinkage R is 0.99 in a case where the initial distance L1*a* is 200 mm and the calculated distance L1*b* is 198 mm.

Step S114: The controller 120 scales down the image to be formed on the second surface 72 based on the shrinkage R. In the following description, the image scaled down by the controller 120 is also referred to as a scaled down image. The process then advances to Step S116.

Step S116: The controller 120 directs the image forming section 30 to form the scaled down image on the second surface 72. The process then advances to Step S118.

Step S118: The controller 120 directs the fixing section 40 to fix toner to the second surface 72 at a second fixing temperature. The second fixing temperature is the ink transparency temperature or higher. Accordingly, the marks 80 formed on the second surface 72 become transparent when the fixing section 40 fixes the toner to the second surface 72. The process then ends.

As described above with reference to FIGS. 1 to 5, the controller 120 calculates the calculated distance L1*b* indicating the distance between the pair of marks based on the detection result of the detector 45 after the fixing section 40 has fixed toner to the first surface 71. The controller 120 then calculates the shrinkage R of the paper P (recording medium) based on the calculated distance L1*b*. Furthermore, the controller 120 directs the image forming section 30 to form an image on the second surface 72 according to the shrinkage R. Accordingly, misalignment between the printing positions of the first surface 71 and the second surface 72 can be prevented even in a case where the paper P has shrunk as a result of fixing to the first surface 71.

Furthermore, the fixing section 40 fixes toner to the first surface 71 at the first fixing temperature which is lower than the specific temperature, and fixes toner to the second surface 72 at the second fixing temperature which is higher than the specific temperature. Accordingly, the marks 80 do not become transparent when printing is performed on the first surface 71. By contrast, the marks 80 become transparent after printing has been performed on the second surface 72. As a result, the controller 120 can measure the distance between the marks after printing has been performed on the first surface 71 to calculate the shrinkage R, and can prevent the marks 80 from obstructing the image by making the marks 80 transparent after printing has been performed on the second surface 72.

The controller 120 scales down the image to be formed on the second surface 72 according to the shrinkage R. Therefore, the entirety of the image can be formed on the paper P even in a case where the paper P has shrunk.

The controller 120 calculates the shrinkage R based on the initial distance L1*a* and the calculated distance L1*b*. The initial distance L1*a* indicates the initial value of the distance between the marks. Accordingly, the shrinkage R of the entirety of the paper P can be estimated using the shrinkage R of the distance between the marks.

The image forming section 30 forms an image on paper P (recording medium) that has been folded. Thus, an image can be formed on the large-sized paper P.

In the image forming apparatus 1 described with reference to FIGS. 1 to 5, the controller 120 scales down the image to be formed on the second surface 72 with respect to the first direction D1. However, the controller 120 may scale down the image to be formed on the second surface 72 with respect to the first direction D1 and the second direction D2.

Figure 6:
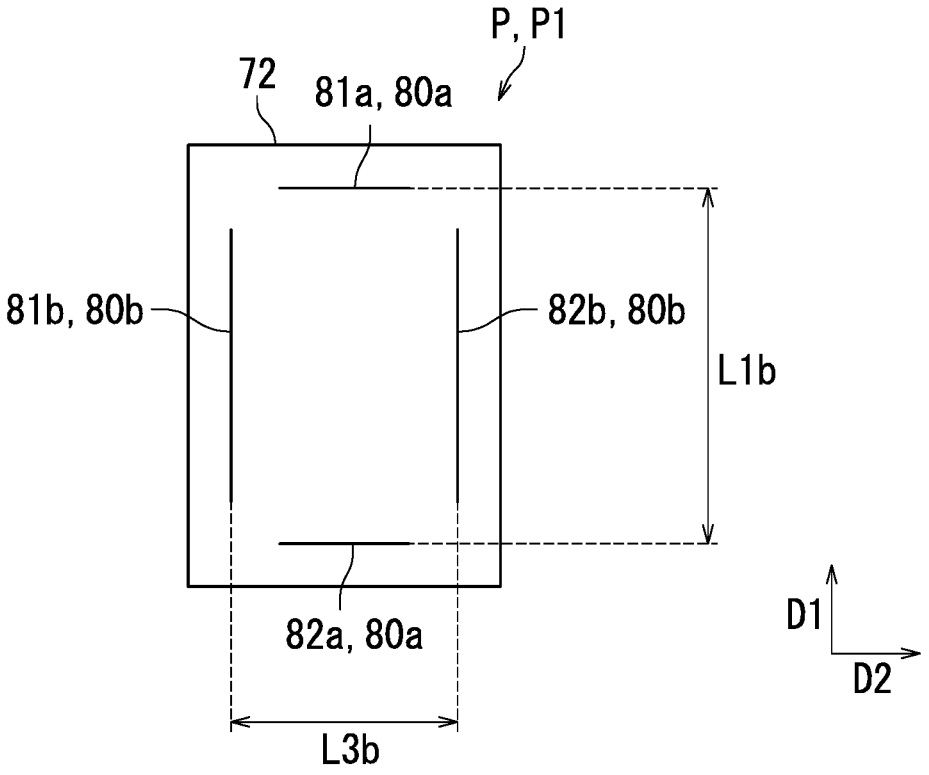
FIG. 6 is a schematic illustration of a second surface of folded paper.

The following describes another image formation method in the large-size printing mode with reference to FIGS. 1 and 6. FIG. 6 is a schematic illustration of a second surface 72 of folded paper P1. In FIG. 6, a calculated distance L1*b* indicates a distance between a first mark 81*a* and a second mark 82*a*. A calculated distance L3*b* indicates a distance between a first mark 81*b* and a second mark 82*b*.

As illustrated in FIG. 6, a pair of marks 80*a* and a pair of marks 80*b* are formed on the second surface 72.

The marks 80*a* include the first mark 81*a* and the second mark 82*a*. The first mark 81*a* and the second mark 82*a* are lines. The first mark 81*a* and the second mark 82*a* are parallel to each other. The first mark 81*a* and the second mark 82*a* extend in the second direction D2.

The marks 80*b* include the first mark 81*b* and the second mark 82*b*. The first mark 81*b* and the second mark 82*b* are lines. The first mark 81*b* and the second mark 82*b* are parallel to each other. The first mark 81*b* and the second mark 82*b* extend in the first direction D1.

The controller 120 calculates a shrinkage R1 with respect to the first direction D1 of the paper P by calculating the calculated distance L1*b*. By contrast, the controller 120 calculates a shrinkage R2 with respect to the second direction D2 of the paper P by calculating the calculated distance L3*b*.

The controller 120 then scales down the image to be formed on the second surface 72 with respect to the first direction D1 and the second direction D2. In detail, the controller 120 scales down the image using the shrinkage R1 with respect to the first direction D1 and the shrinkage R2 with respect to the second direction D2.

As described above with reference to FIGS. 1 and 6, the controller 120 scales down the image to be formed on the second surface 72 with respect to the first direction D1 and the second direction D2. The first direction D1 is parallel to the conveyance direction Dc of the paper P. The second direction D2 is orthogonal to the first direction D1. Accordingly, misalignment between the printing positions of the first surface 71 and the second surface 72 can be prevented even in a case where the shrinkage R1 in the first direction D1 and the shrinkage R2 in the second direction D2 differ from each other.

The embodiment of the present disclosure is described above with reference to the drawings (FIGS. 1 to 6). However, the present disclosure is not limited to the above-described embodiment and may be implemented in various manners within a scope not departing from the gist thereof (as below in (1) to (3), for example). The drawings are schematic illustrations that emphasize elements of configuration in order to facilitate understanding thereof. Properties of the elements of configuration illustrated in the drawings, such as thickness, length, and number thereof, may differ from actual properties thereof in order to facilitate preparation of the drawings. Properties of the elements of configuration described in the above-described embodiment such as material, shape, and dimensions thereof are examples, not particularly limited, and may be variously altered within a scope not substantially departing from the effects of the present disclosure.

(1) As described with reference to FIGS. 1 to 6, the folded paper P1 is housed in the dedicated paper feed cassette 11*a*, but the present disclosure is not limited as such. For example, the folded paper P1 may be loaded on the manual feed tray 16.

(2) As described with reference to FIGS. 1 to 6, the image forming apparatus 1 performs printing on the folded paper P1 according to the shrinkage R of the folded paper P1 in the large-size printing mode, but the present disclosure is not limited as such. For example, the image forming apparatus 1 may perform printing on unfolded paper P according to the shrinkage R of the paper P in the duplex printing mode. In this case, an obverse surface of the paper P corresponds to the first surface 71 and a reverse surface of the paper P corresponds to the second surface 72. That is, the controller 120 may scale down an image to be formed on the reverse surface (second surface 72) according to the shrinkage R after toner has been fixed to the obverse surface (first surface 71).

(3) As described with reference to FIGS. 1 to 6, the image forming apparatus 1 is a color multifunction peripheral, but the present disclosure is not limited as such. The image forming apparatus 1 may be a monochrome multifunction peripheral, for example.

What is claimed is:

1. An image forming apparatus comprising:

an image forming section configured to form an image on a recording medium with a first surface and a second surface;

a fixing section configured to fix toner to the recording medium;

a detector configured to detect a pair of marks formed on the second surface; and a controller configured to control the image forming section, the fixing section, and the detector, wherein the pair of marks is formed with ink that becomes transparent at a specific temperature or higher, the controller:

calculates a calculated distance indicating a distance between the pair of marks based on a detection result of the detector after the fixing section has fixed the toner to the first surface; and calculates a shrinkage of the recording medium based on the calculated distance and directs the image forming section to form an image on the second surface according to the shrinkage, and the fixing section fixes the toner to the first surface at a first fixing temperature which is lower than the specific temperature, and fixes the toner to the second surface at a second fixing temperature which is higher than the specific temperature.

2. The image forming apparatus according to claim 1, wherein the controller scales down the image to be formed on the second surface according to the shrinkage.

3. The image forming apparatus according to claim 1, wherein the controller calculates the shrinkage based on the calculated distance and an initial distance indicating an initial value of the distance between the pair of marks.

4. The image forming apparatus according to claim 3, further comprising an input section configured to receive input of the initial distance.

5. The image forming apparatus according to claim 1, wherein the pair of marks includes a first mark and a second mark, the first mark and the second mark are lines, and the first mark and the second mark are parallel to each other.

6. The image forming apparatus according to claim 1, wherein the controller scales down the image to be formed on the second surface with respect to a first direction and a second direction, the first direction is parallel to a conveyance direction of the recording medium, and the second direction is orthogonal to the first direction.

7. The image forming apparatus according to claim 1, wherein the recording medium is folded, and the image forming section forms an image on the folded recording medium.

* * * * *